US005979677A

United States Patent [19]

Simpson, II et al.

[11] Patent Number: 5,979,677

[45] Date of Patent: Nov. 9, 1999

[54] STACKABLE COLLECTIBLE DISPLAY STAND WITH INTERCHANGEABLE SCENIC CARDS

[75] Inventors: Morton Simpson, II, Edison; Michael Pfeifer, Plainsboro, both of N.J.; Stuart Karten; Eric Olson, both of Marina Del Rey, Calif.

[73] Assignee: Collectible Display Systems, Inc., Edison, N.J.

[21] Appl. No.: 09/021,903

[22] Filed: Feb. 11, 1998

[51] Int. Cl.[6] ..... A47B 47/00

[52] U.S. Cl. ..... 211/188; 211/13.1; 211/194

[58] Field of Search ..... 211/188, 194, 211/85.5, 126.2, 13.1; 108/55.3; 40/411, 414

[56] References Cited

U.S. PATENT DOCUMENTS

| | | | |
|---|---|---|---|
| D. 168,646 | 1/1953 | Erickson | 211/85.5 |
| 3,768,637 | 10/1973 | Whang | 206/44 R |
| 3,964,810 | 6/1976 | Murphy | 211/188 |
| 4,366,905 | 1/1983 | Forshee | 206/511 |
| 4,428,487 | 1/1984 | Hepp | 211/126 |
| 4,508,230 | 4/1985 | Ashton | 211/181 |
| 4,706,824 | 11/1987 | Mercer | 211/188 |
| 4,757,769 | 7/1988 | Suttles | 211/188 |
| 4,930,643 | 6/1990 | Flum | 211/188 |
| 4,955,485 | 9/1990 | Alton | 211/14 |
| 4,976,360 | 12/1990 | Zucker | 211/186 |
| 5,158,187 | 10/1992 | Taub | 211/186 |
| 5,398,820 | 3/1995 | Kiss | 211/13.1 |

FOREIGN PATENT DOCUMENTS

| | | | |
|---|---|---|---|
| 286431 | 2/1953 | Switzerland | 211/188 |
| 649967 | 2/1951 | United Kingdom | 211/188 |

*Primary Examiner*—Blair M. Johnson

*Attorney, Agent, or Firm*—Fulwider Patton Lee & Utecht, LLP

[57] ABSTRACT

The invention is directed to a display stand which generally includes a series of stacked platforms with a means to attach figurines to the top of each platform. Each platform also includes a back surface composed of display columns and scenic cards which may contain appropriate scenery to the figurines. The platforms are stacked upon these display columns and support columns with each platform having attachment means on both upper and lower surfaces. The figurines can therefore be displayed on multiple levels with appropriate scenery.

17 Claims, 7 Drawing Sheets

STACKABLE COLLECTIBLE DISPLAY STAND WITH INTERCHANGEABLE SCENIC CARDS

BACKGROUND OF THE INVENTION

The invention relates to a system for viewing and displaying figurines. More particularly, the invention relates to a system which provides an attractive and appropriate setting for displaying figurines on multiple levels.

The acquiring of various figurines has become increasingly popular in the last several years. These figurines can be acquired for the purpose of collecting and playing. The displaying of such figurines has also increased in popularity. The artful display of figurines in an appropriate setting has become recognized as a desirable and important part of collecting and playing.

It is generally known in the art to display figurines by placing them on a shelf-like structure. This provides a convenient format for viewing the figurines on multiple levels. It is also known in the art to secure collectibles onto a stand. These prior methods lacked appropriate settings to enhance the viewing and displaying of figurines.

Specifically the prior art includes shelf-like structures, such as described in U.S. Pat. No. 4,508,230 by Ashton and U.S. Pat. No. 5,158,187 by Taub. These patents disclose vertically stackable trays for the display of commercial products. Ashton further discloses a means to support display panels on the outside of the stackable trays. What these inventions lack is a means to securely display products to be viewed with appropriate scenery.

What has been needed and heretofore unavailable is a means for securely displaying figurines on multiple levels with appropriate settings. The present invention satisfies this need.

SUMMARY OF THE INVENTION

The invention provides a unique and enhanced format for the viewing and displaying of collectible figurines. The figurines are presented on multiple levels with appropriate scenery as a backdrop. The invention itself is a display stand with multiple platforms for mounting the figurines. Each platform includes a back surface to which scenic cards can be added. The overall effect is that of a multi-level diorama.

The novel features of the invention include platforms with pegs attached for mounting the figurines. The platforms may comprise a multitude of shapes and configurations. Separate sections may be used to construct a single platform. Furthermore, a variety of peg configurations may be used for the mounting of the figurines. When mounted on these platforms the figurines appear to be standing thereon, and possibly interacting with other figurines and the scenic cards on the back surface.

The back surface is another novel feature which is composed of scenic cards held by display columns. The display columns serve both the function of holding the card and supporting successive platforms. The display columns may also have various configurations corresponding with the different configurations of the platforms. The scenic cards are mounted between two such display columns and may be interchangeable to correspond with the figurines.

The display stand also includes support columns which support successive platforms without unduly hindering the view of the figurines. These support columns may attach to the platforms in a variety of ways. Holes within the platforms can support one column from below and another from above. Indentations in the upper surface of the platform with corresponding protrusions in the lower surface may also support columns from above and below. By using the support columns and display columns any number of platforms may be stacked upon each other. Regardless of the number stacked, one platform will always constitute the uppermost platform.

This uppermost platform will have a back surface composed of free-standing display columns and scenic cards. These free-standing display columns may or may not be identical with the other display columns. The uppermost platform may also include additional features such as caps to cover holes in the platform.

Other features and advantages of the invention will become apparent from the following detailed description, taken in conjunction with the accompanying drawings, which illustrate, by way of example, the features and preferred embodiments of the invention.

DETAILED DESCRIPTION OF THE PREFERRED EMBODIMENTS

Figure 1:
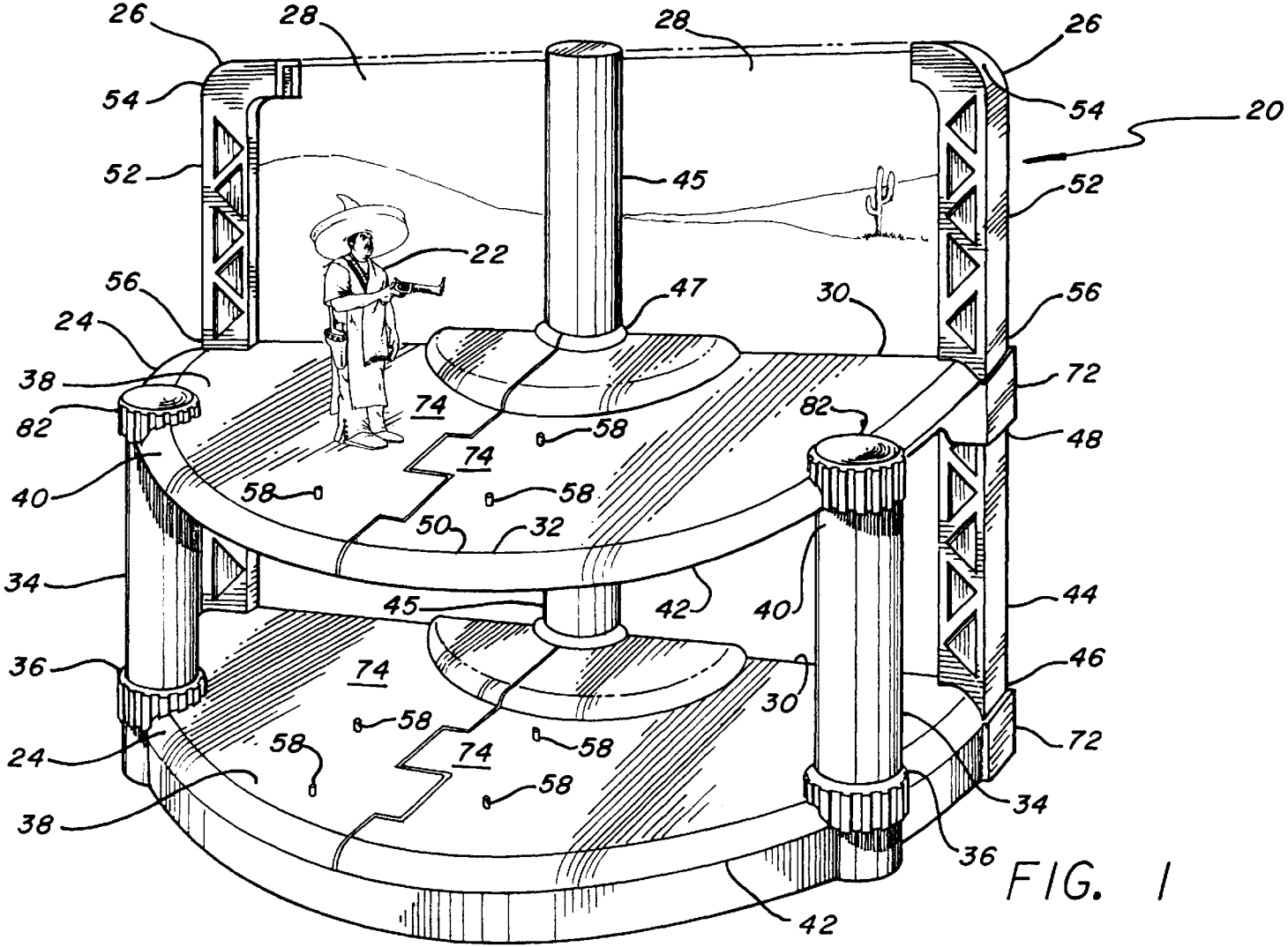
FIG. 1 is a perspective illustration depicting a preferred embodiment of the display stand.
Figure 2:
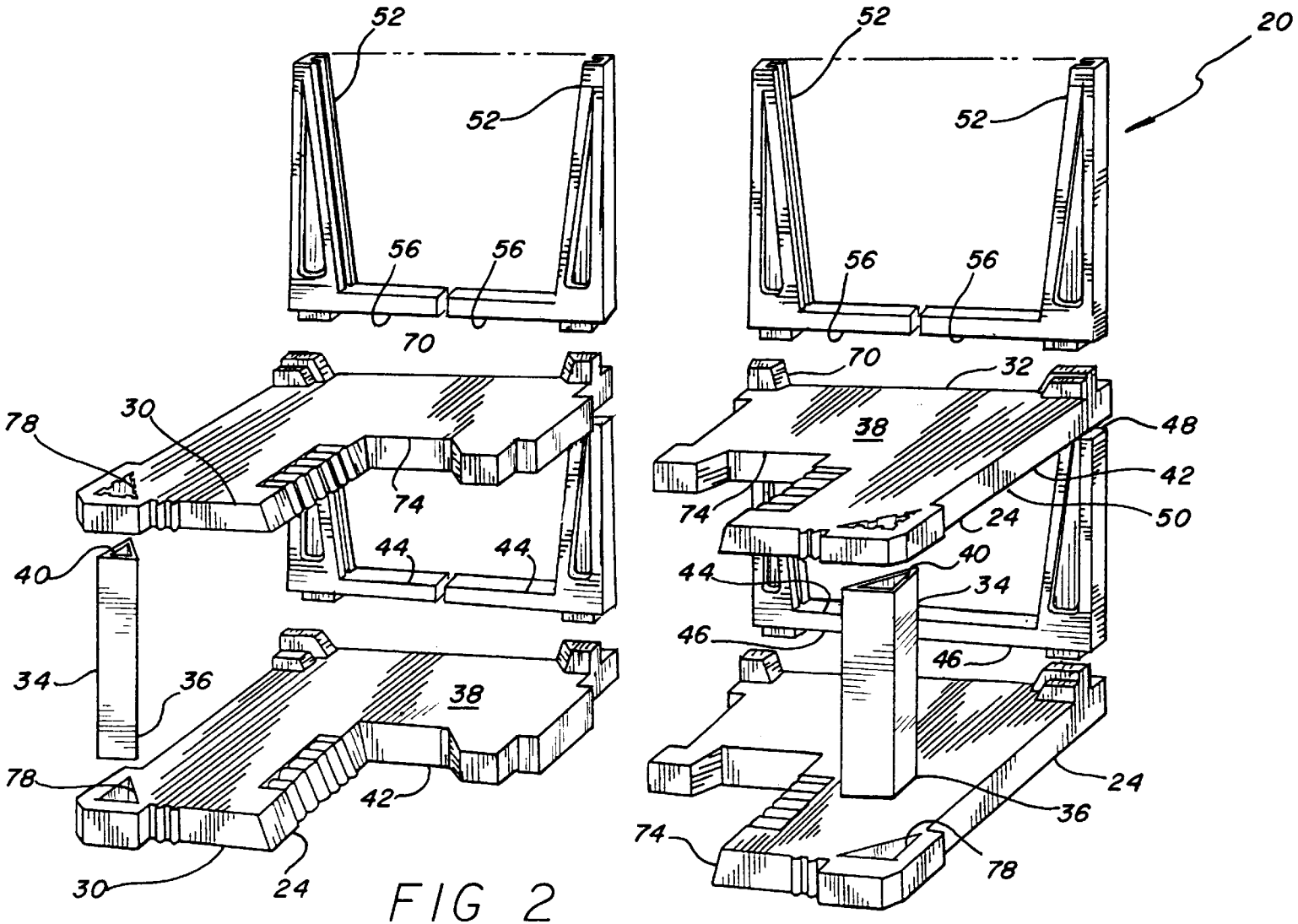
FIG. 2 is a perspective illustration depicting a second preferred embodiment of the display stand.

FIGS. 1 and 2 illustrate, by way of example, different embodiments of a novel display stand 20 for the display of small ornamental figures or replicas of famous characters or persons, hereinafter generally referred to as figurines 22. Generally, the display stand 20 includes multiple platforms 24 which can be stacked to display the figurines 22 on different levels. The display stand 20 includes a back surface 26 imprinted with scenery on interchangeable scenic cards 28. In this way, the figurines 22 can be viewed against appropriate scenes, which gives the overall effect of a multi-level diorama. This display stand 20, by way of these novel features, presents a unique and enhanced method for displaying collectible figurines.

The display stand 20 is composed of at least two platforms 24. The rear end 30 of each platform 24 supports a portion of the back surface 26. The front end 32 of each platform is open for viewing. The front ends 32 have support columns 34 which span between the platforms 24. The lower end 36 of each support column is adapted to attach to the upper surface 38 of the platforms 24. The upper end 40 of each support column is adapted to attach to the lower surface 42 of the platforms.

The back surface 26 of each platform 24 is composed of at least two display columns 44, and a display panel imprinted with appropriate scenery herein referred to as a scenic card 28. The lower end 46 of each display column 44 is adapted to attach to the upper surface 38 of the platform 24. The upper end 48 of each display column 44 is adapted to attach to the lower surface 42 of the platforms 24. The display columns 44 are adapted to hold the scenic cards 28 between two such display columns 44 by each display column 44 being adapted to receive one end of the scenic card 28.

The back surface 26 of each platform 24 may further comprise a central display column 45. The lower end 47 of the central display column 45 is adapted to attach to the upper surface 38 of the platform 24. The upper end 49 of the central display column 45 is adapted to attach to the lower surface 42 of the platforms 24. The central display column 45 is adapted to receive two display cards 28 such that two display cards 28 are supported between the central display column 45 and two display columns 44.

Since each platform 24 can be attached to the support columns 34, the display columns 44, and the central display columns 45 at the upper surface 38 and the lower surface 42, the platforms may be successively stacked upon support columns and display columns extending upwardly from the platform below. Each attachment is removable such that the display stand 20 may be readily disassembled and reassembled. The display stand 20 may therefore have as many levels as desired. The display stand will always define an uppermost platform 50, upon which no platform has been stacked higher.

This uppermost platform 50 may further support free-standing display columns 52. These free-standing display columns 52 may be identical to the other display columns 44 or central display columns 45. Since the free-standing display columns need not support a successive platform 24, however, the upper end 54 of the free-standing display columns 52 need not be adapted to attach to the lower surface 42 of the platforms 24. The lower end 56 of each free-standing display column 52 is adapted to be attached to the upper surface 38 of the platforms 24. The free-standing display columns 52 are also adapted to hold a scenic card 28 between two such free-standing display columns 52. This allows the back surface 26 to extend above the uppermost platform 50. Figurines 22, on the uppermost platform 50 are therefore also viewed with appropriate scenes.

Figure 3:
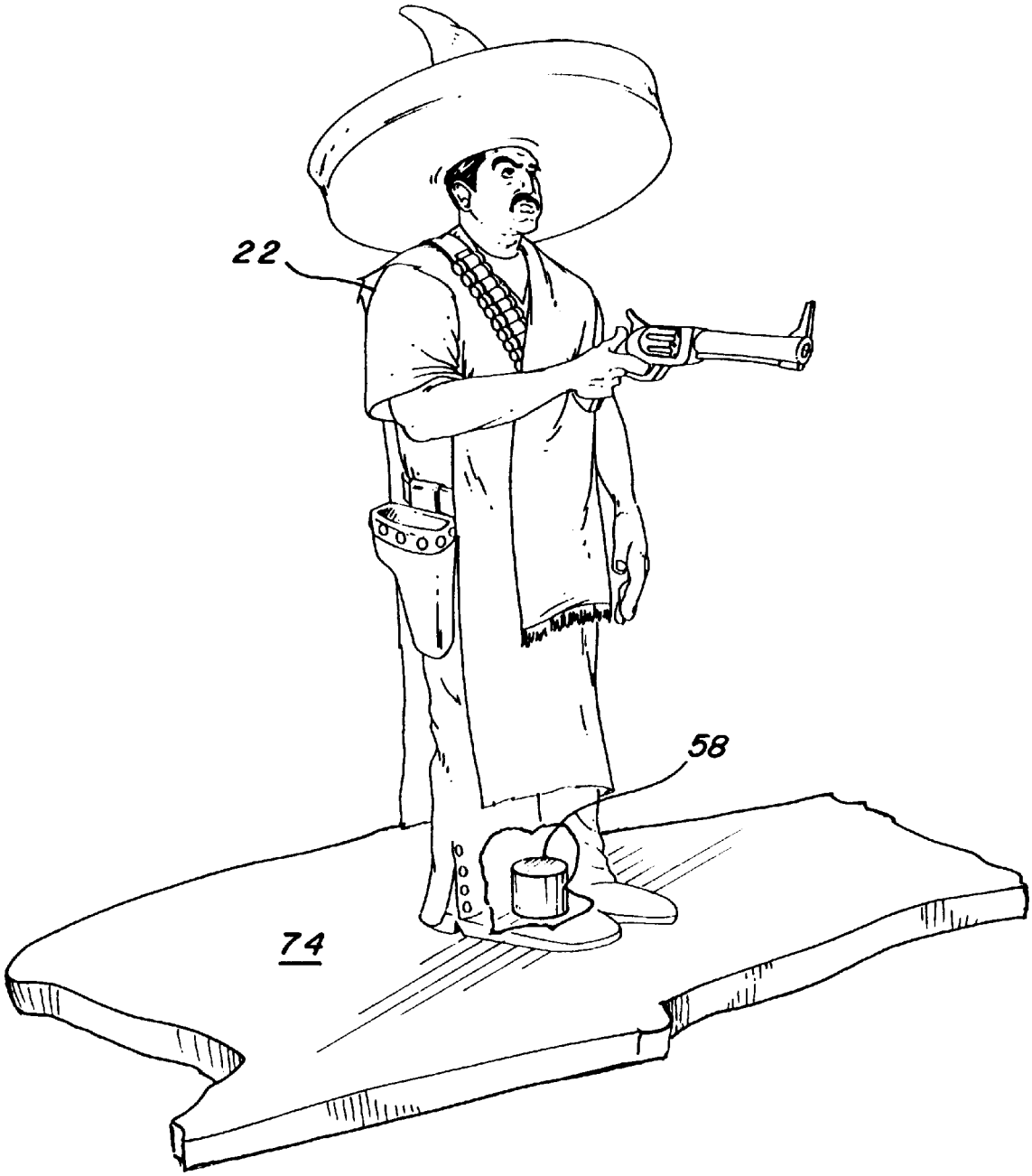
FIG. 3 is a perspective illustration depicting a figurine mounted on a peg.

One method of mounting the figurines 22, as illustrated in FIG. 3, is by having pegs 58 attached to the upper surface 38 of each platform 24. A specially designed figurine 22 may then be removably mounted on the peg and held in place on the platform 24 by inserting the peg 58 into the figurine 22. The figurine 22 would then appear to be standing on the platform 24 and possibly interacting with other figurines 22 and the appropriate scenes depicted on the scenic cards 28.

Figure 4A:
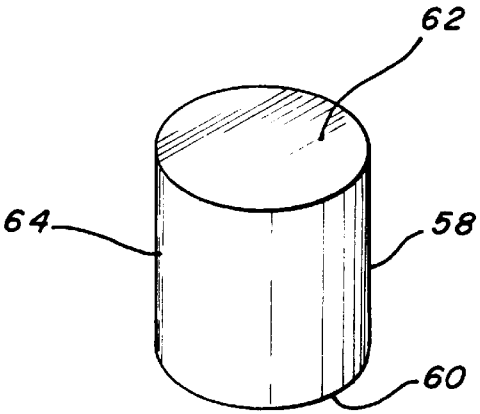
FIG. 4A is an enlarged perspective illustration depicting a cylindrical peg with a circular cross-section.

These pegs 58 may have a variety of configurations as shown in FIGS. 4A, 4B, 4C and 4D. The lower end 60 of each peg is mounted onto the upper surface 38 of the platforms 24. The upper end 62 of the peg 58 may then be inserted into the figurine 22. The cross-section of the shaft 64 of the peg 58 may be varied to insert within appropriate figurines 22. The preferred embodiment, as depicted in FIG. 4A, is for the peg 58 to be cylindrical and the cross-section of the shaft 64 to be circular.

Figure 4B:
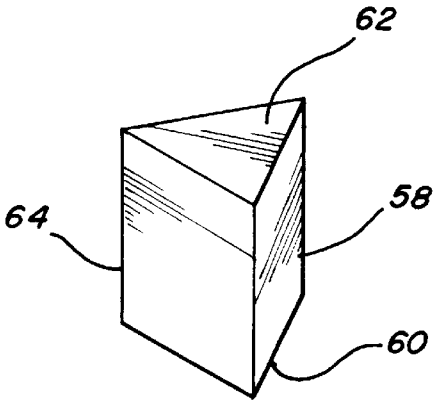
FIG. 4B is an enlarged perspective illustration depicting a multi-faceted peg with a triangular cross-section.
Figure 4C:
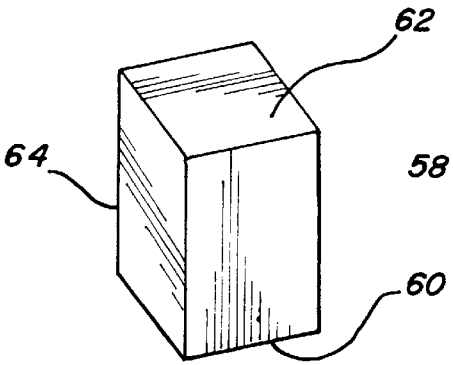
FIG. 4C is an enlarged perspective illustration depicting a multi-faceted peg with a square cross-section.
Figure 4D:
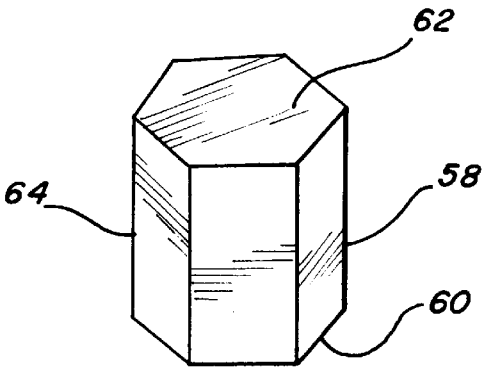
FIG. 4D is an enlarged perspective illustration of a multi-faceted peg with a hexagonal cross-section.

The pegs 58 may also be multi-faceted, the shaft 64 having a polygonal cross-section. Possible embodiments would be a triangular cross-section, as depicted in FIG. 4B, a square cross-section, as depicted in FIG. 4C, or a hexagonal cross-section, as depicted in 4D. Those skilled in the art will realize that many configurations are possible for the peg 58 which do not vary significantly from the scope of this invention. Furthermore, the means for attaching the figurines 22 may comprise slots, indentations, or similar attaching devices without varying significantly from the scope of this invention.

Preferably, these pegs 58 are formed integrally with the platforms 24. The pegs 58 may also be formed separately and attached to the platform 24 as desired. If the pegs 58 are formed separately the pegs 58 and platform 24 will include attachment means (not illustrated). Those skilled in the art will be aware that there exists several modes of attaching the pegs 58 to the platforms 24.

Figure 5B:
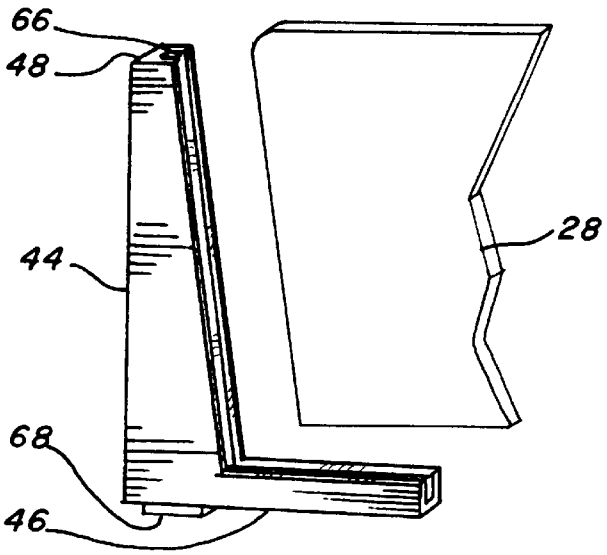
FIG. 5B is a perspective illustration depicting a preferred embodiment of a display column and a scenic card.
Figure 5C:
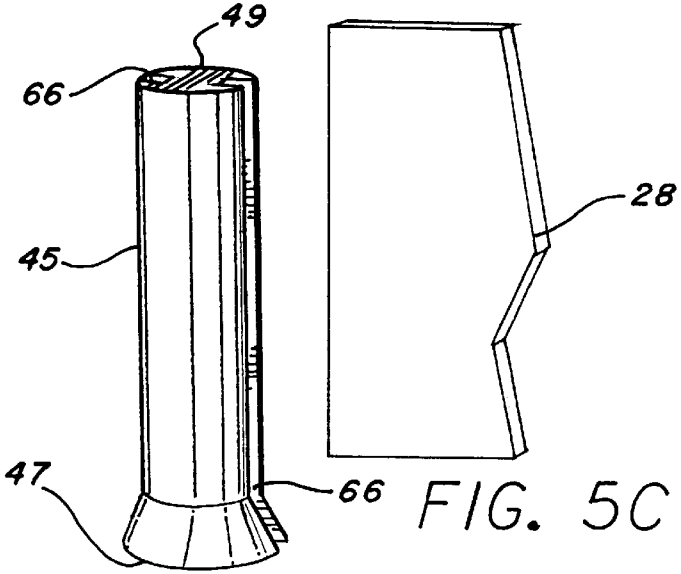
FIG. 5C is a perspective illustration depicting a preferred embodiment of a central display column.
Figure 5A:
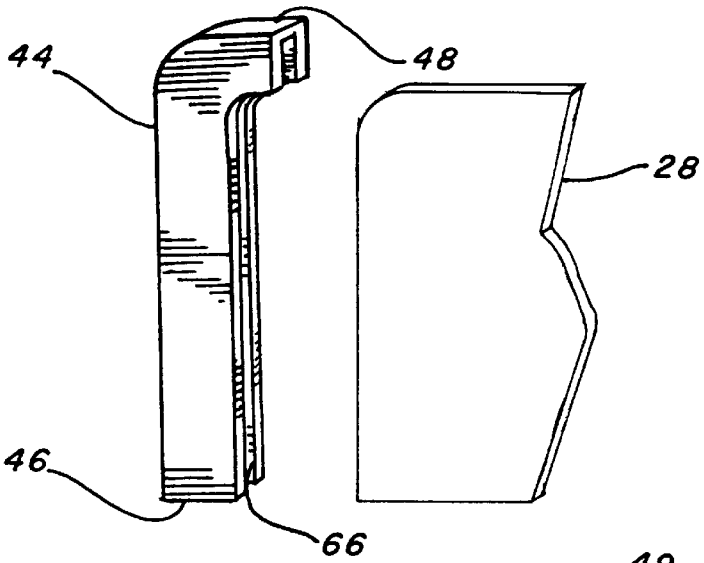
FIG. 5A is a perspective illustration depicting a preferred embodiment of a display column and a scenic card.

The display columns 44 may have different configurations to perform the functions of supporting successive platforms 24 and supporting scenic cards 28. Three preferred embodiments are depicted in FIGS. 5A, 5B and 5C. The embodiment depicted in FIG. 5A is a straight column with a curved portion at the upper end 48. The embodiment depicted in FIG. 5B is a slanted column which is open at the upper end 48 and has a wide base at the lower end 46. These embodiments have slots 66 in one side so that they can support a scenic card 28 which is slid into the slot. The central display column 45 embodiment depicted in FIG. 5C has a cylindrical shape and has slots on two sides so that it can support scenic cards 28 on both sides. Furthermore, these display columns 44 may be supported on the upper surface 38 of the platforms 24 in a variety of methods. The display column embodiment depicted in FIG. 5B, by the way of example, has a tab 68 affixed at the lower end. This tab may be inserted into a slot 70 on the upper surface of the platform 24 (depicted in FIG. 2). Embodiments without tabs 68 may be supported by inserting the lower end 47 of the display column into a receptacle 72 (depicted in FIG. 6) formed in the platform 24. Those skilled in the art will be aware that many configurations of display columns 44 may be constructed which do not vary significantly from the scope of this invention.

The preferred embodiment for the free-standing display columns 52 is to be identical to the display columns 44 that support successive platforms 24. The embodiments depicted in FIGS. 5A, 5B, 5C can function equally well as free-standing and supportive display columns. It should be realized, however, that the free-standing display columns 52 need not have the same configuration as the display column 44 or the central display column 45.

The platforms 24 serve to support the figurines 22 to be displayed and to create the multiple levels of this novel invention. These platforms can be in multiple configurations which vary the decorative and utilitarian functions of the platforms 24. The distal end 32 of the platform, which is generally open for viewing, may have a half-circle configuration, depicted in FIG. 1, or a multifaceted configuration, depicted in FIG. 2.

Figure 6:
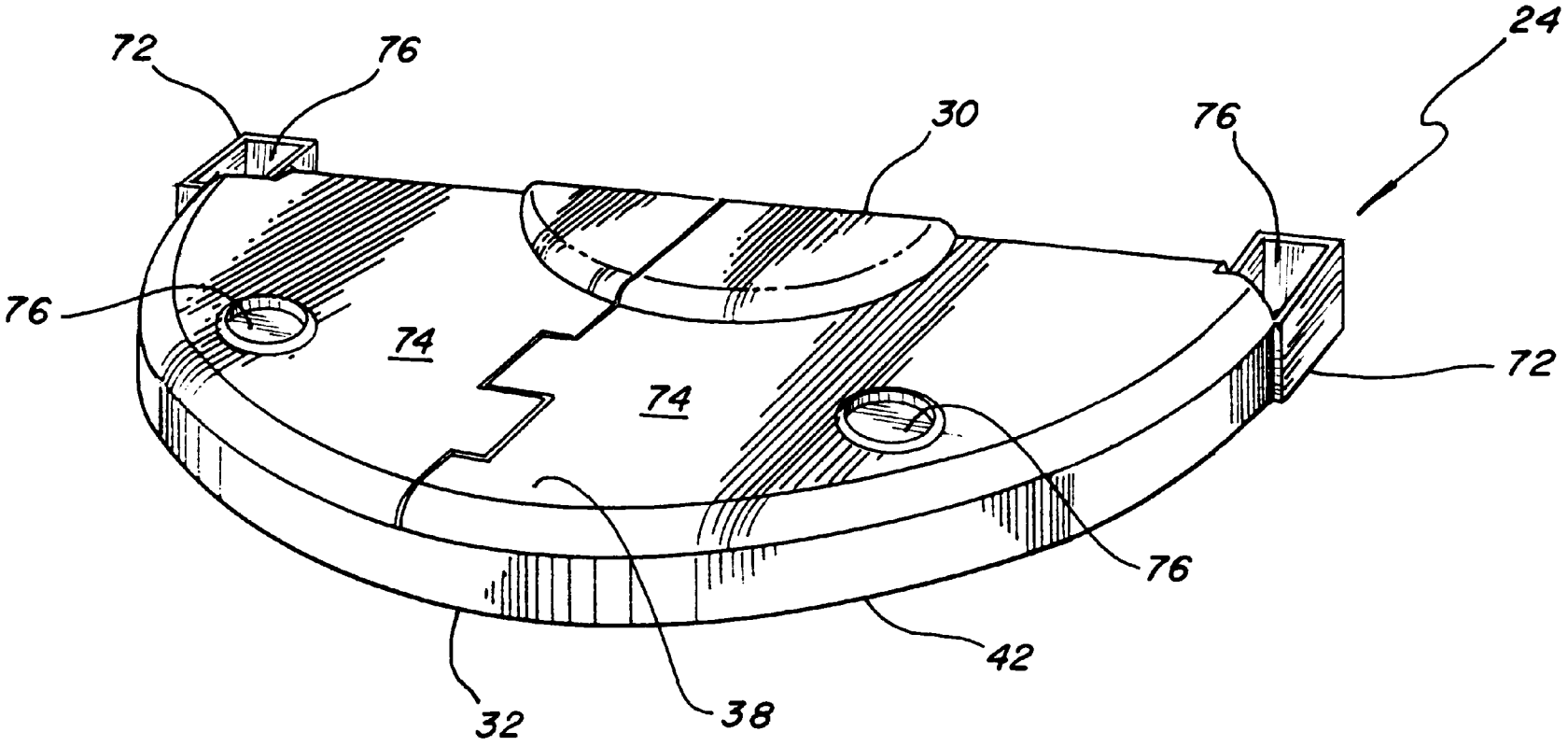
FIG. 6 is a perspective illustration depicting a platform with multiple interlocking sections.

The platform 24 itself may be composed of multiple sections 74. These sections 74 comprise a portion of the upper surface 38 and the lower surface 42 and are combined to form a complete platform 24. Preferably, these sections will be interlocking, as depicted in FIG. 6. The sections 24 may be connected together to form a complete platform 24 in many ways without varying from the scope of this invention. Constructing the platforms 24 in multiple sections 74 facilitates the manufacture and shipping of the display stand 20.

The platforms 24 also serve to support the display columns 44 and the support columns 34. The upper surface 38 of the platform 24 may be adapted to receive the lower end 36 of the support column 34 in a variety of configurations. A preferred configuration, depicted in FIG. 1 and FIG. 6, is to have holes 76 defined in the platform. These holes 76 receive the lower end 36 of a first support column 34 from the upper surface 38 and removably secure it. These same holes 76 also receive the upper end 48 of a second support column 34 from the lower surface 42 and removably secure it.

This same method of securing the support columns 34 from holes 76 in the platforms 24, may be used to support the display columns 44 as well. The holes 76 may be built into receptacles 72 as depicted in FIG. 6. These receptacles 72 are attached to the platform 24 such that the display columns 44 form part of the back surface 26.

Figure 7B:
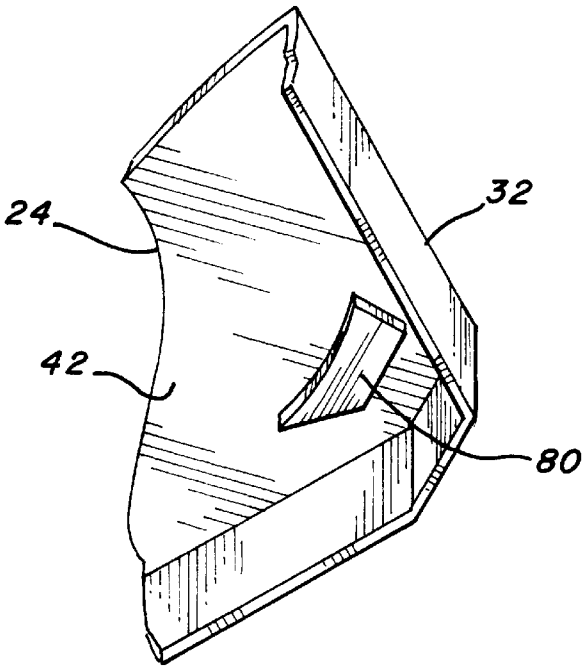
FIG. 7B is a perspective illustration of a protrusion viewed from the lower surface of a platform.
Figure 7A:
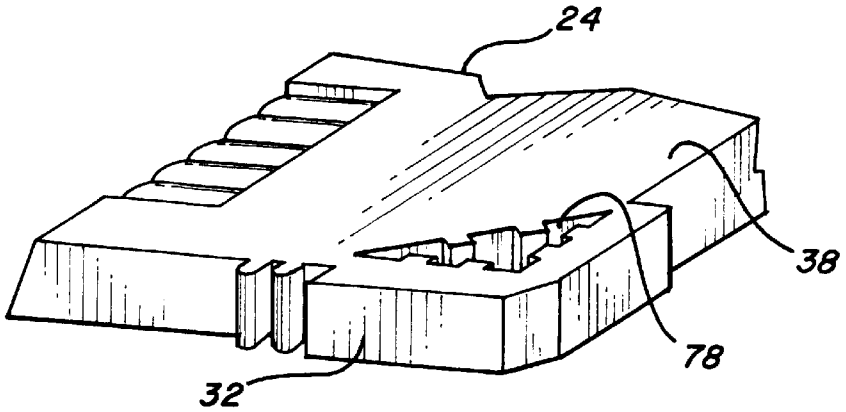
FIG. 7A is a perspective illustration of an indentation viewed from the upper surface of a platform.

Furthermore, the support columns 34 may be supported by indentations 78 in the upper surface 38 of the platforms 24 (depicted in FIG. 7A). Since the platform 24 is typically composed of a lightweight plastic, the indentation 78 in the upper surface 38 corresponds to a protrusion 80 in the lower surface 42 (depicted in FIG. 7B). As depicted in FIG. 2, the support columns 34 may be formed so as to be received into the indentations 78 at their lower end 46 and to receive a protrusion into their upper end 48. Similar methods may be used to support the display columns 44.

A cap 82, depicted in FIG. 1, may be used in the configurations with holes 76. These caps 82 cover the holes 76 in the uppermost platform 24.

These display stands 20 may be composed of a number of materials. The preferred composition is molded plastic. This invention does not comprise significant manufacturing challenges and those skilled in the art will readily understand that many methods may be used to manufacture all of the components of the display stand 20. Although plastic is a natural choice for such display stands 20, wood and metal may also be used and are within the scope of this invention. The scenic cards 28, will most likely be composed of paper products, however, other compositions of scenic cards 28 are possible.

It should be appreciated that preferred embodiments have been described in the proceeding paragraphs and the accompanying figures. The scope of the invention should not be limited by these descriptions which have been provided for exemplary use. Those skilled in the art will readily recognize the novelty of this display stand 20 and that various modifications can be made without varying from the scope of the invention.

What is claimed is:

1. A display stand for displaying figurines depicting persons or characters comprising in combination:

a plurality of platforms having an upper surface, a lower surface, a front end, and a rear end;

at least one figurine;

at least one attachment means positioned on and at least partially offset from the upper surface of each said platform adapted to removably attach said at least one figurine to said platform, said figurine being an ornamental, and not a structural, component of said display stand;

a plurality of first columns having an upper end adapted to be attached to the lower surface of the platforms, a lower end adapted to be attached to the upper surface of the platforms and a shaft therebetween;

at least one said platform spaced from and supportably stacked above another said platform by attaching said first columns between each said platform;

a plurality of free-standing second columns each having securing means for an imprinted card between two free-standing second columns, said freestanding second columns attached to the upper surface of the uppermost platform; and at least one imprinted card releasably secured within said securing means of said free-standing second columns.

2. The display stand of claim 1 wherein at least two of said first columns mounted between the platforms have means for securing an imprinted card between said first columns, and further comprising at least one imprinted card secured between said first columns.

3. The display stand of claim 1, further comprising at least one central third column having an upper end adapted to be attached to the lower surface of the platforms, a lower end adapted to be attached to the upper surface of the platforms, and a shaft there between having means for securing at least two imprinted cards, said central third column attached between said platforms between two said first columns.

4. The display stand of claim 1, wherein the attachment means comprise at least one peg configured to mate with a corresponding hole in a figurine.

5. The display stand of claim 4 wherein the pegs are formed integrally with the platform.

6. The display stand of claim 1 wherein the platforms are composed of a plurality of interlocking sections.

7. The display stand of claim 1, wherein the front end of at least one of the platforms is formed in a half-circle.

8. The display stand of claim 1, wherein the front end of at least one of the platforms is formed as a multi-faceted configuration.

9. The display stand of claim 1, wherein each said platform defines at least one indentation in the upper surface which is adapted to removably receive the lower end of one said first column and at least one protrusion on the lower surface which is adapted to removably receive the upper end of one said first column.

10. The display stand of claim 1, wherein each platform defines at least one hole which passes through the platform from the upper surface to the lower surface, wherein the holes are adapted to receive the lower end of one said first column from the upper surface and adapted to receive the upper end of one said first column from the lower surface.

11. The display stand of claim 10 further comprising at least one cap which is adapted to cover the hole in the upper surface of the platform.

12. The display stand of claim 1, wherein each platform defines at least one receptacle which defines a hole adapted to receive the lower end of one said first column from the upper surface and adapted to receive the upper end of one said first column from the lower surface.

13. The display column of claim 1, wherein the attachment components comprise at least one indentation configured to mate with at least one peg attached to a figurine.

14. The display stand of claim 1, further comprising:

at least one figurine depicting a person or character removably attached to said platforms.

15. A display stand for displaying collectible figurines comprising, in combination:

a plurality of platforms each having an upper surface, a lower surface, a front end and a rear end;

at least one fastener on the upper surface of each platform configured to releasably fasten a figurine to said platform;

at least one figurine having the likeness of a person or character releasably fastened to the upper surface of said platforms, such figurine being an ornamental, and not a structural component of the display stand;

a plurality of columns each having an upper end removably attached to the lower surface of said platforms and lower end removably attached to the upper surface of said platforms;

at least two columns each having a lower end removably attached to the upper surface of the upper most platform near the rear end of said platform; and at least one imprinted panel removably secured between said columns attached to one or more of the platforms such that the view to the panel is substantially unobstructed by columns attached to the front end of the uppermost platform, when viewed from the front of the display stand.

16. The display stand of claim 15 further comprising:

at least one indentation in the upper surface of said platforms which is adapted to removably receive the lower end of said columns; and at least one protrusion in the lower surface of said platforms which is adapted to removably receive the upper end of said columns.

17. In a multi-level stand for the display of collectible figurines composed of stackable platforms supported by columns, having a front end and a back end wherein the improvement comprises the combination of:

at least one card having scenes imprinted thereon supported between the columns;

at least one figurine in the form of a person for display on at least one of the platforms in front of the card; and releasable attachment means for releasably securing said at least one figurine to a platform comprising releasably mating components positioned on said at least one figurine and said platform.

* * * * *

UNITED STATES PATENT AND TRADEMARK OFFICE

CERTIFICATE OF CORRECTION

PATENT NO. : 5,979,677

DATED : Nov. 9, 1999

INVENTOR(S) : Morton Simpson II, Michael Pfeiffer, Stuart Karten, Eric Olson

It is certified that error appears in the above-identified patent and that said Letters Patent is hereby corrected as shown below:

Column 5, line 2, change "24", to read --74--.

Column 6, claim 1, line 12, change "freestanding", to read --free-standing--.

Signed and Sealed this

Twenty-third Day of May, 2000

*Attest:*

Q. TODD DICKINSON

*Attesting Officer*

*Director of Patents and Trademarks*